United States Patent [19]

Zimmer

[11] 4,195,542

[45] Apr. 1, 1980

[54] QUICK DETACHABLE MAGNETIC SPACING MEANS FOR ROTARY SLITTING KNIVES

[75] Inventor: Roy J. Zimmer, Rocky River, Ohio

[73] Assignee: Cowles Tool Company, Cleveland, Ohio

[21] Appl. No.: 963,380

[22] Filed: Nov. 24, 1978

[51] Int. Cl.[2] ..... B26D 1/24

[52] U.S. Cl. ..... 83/664; 83/665; 83/676; 51/168; 85/51; 403/DIG. 1

[58] Field of Search ..... 83/664, 665, 666, 676; 403/DIG. 1; 409/234; 407/31; 51/168; 85/51

[56] References Cited

U.S. PATENT DOCUMENTS

| | | | |
|---|---|---|---|
| 2,613,571 | 10/1952 | Herman | 83/51 |
| 2,851,917 | 9/1958 | Frew | 83/51 |
| 3,081,661 | 3/1963 | MacPherson | 83/676 |
| 3,520,221 | 7/1970 | Thomas | 83/664 |

*Primary Examiner*—J. M. Meister

[57] ABSTRACT

Quickly adjustable, magnetically detachable spacing means for rotary slitting or shearing knives which permit the knives and spacing means to be loosened axially by the arbor nut and remain near their working positions on their supporting arbor while the axial spacing of any pair or pairs of knives is being changed. The spacing means may comprise one or more spacers of magnetic material and of conventional annular form and axial length having close sliding fit on the arbor. The spacer nearest a knife may carry permanent magnets with their poles near the axial face of the spacer proximate the knife to which semi-annular magnetic shims have been magnetically and detachably secured on diametrically opposite sides of the arbor. Substitution of a selected thicker or thinner pair of similar shims will increase or decrease the spacing of the knives as may be desired as by sliding the shims radially on the axial face of the spacer and over the poles of the magnets. Magnest may be secured in both axial end faces of spacers. Shims may be held magnetically between spacers. Spacers like shims, may take semi-annular form being split diametrically, each half spacer having no more than 180° of circumferential length and fit the arbor snugly. The semi-annular spacers preferably have magnets at both axial ends to afford secure magnetic engagement with magnetic parts at one or both ends.

9 Claims, 9 Drawing Figures

QUICK DETACHABLE MAGNETIC SPACING MEANS FOR ROTARY SLITTING KNIVES

BRIEF SUMMARY OF THE INVENTION

The generally known problem of the inordinate loss of time required to change the spacing of rotary slitting knives on their supporting arbors, with the accompanying waste of down-time when all, or many of the knives and spacers must be removed axially, sorted out, changed and returned axially, is related in the U.S. Frew and Morton Pat. No. 2,851,917 issued Sept. 16, 1958 and the U.S. Thomas Pat. No. 3,520,221 issued July 14, 1970.

An object of my invention is to improve upon the intended solutions of the problem stated in those prior patents, and provide method and means for changing the spacing between rotary slitting knives more quickly, safely, easily and more accurately than the prior art has known or taught.

My invention in one form provides magnetic adhesion between annular, and/or semi-annular pairs of, spacers and pairs of semi-annular shims for quick detachable engagement therebetween and for easy substitution of one pair of shims or spacers for another to change the spacing between knives adjacent thereto without removing any knife or any annular spacer from its arbor.

My invention comprehends the use of a pair of semi-annular shims of magnetic material held magnetically on an annular or semi-annular spacer, in one axial face, or both axial faces, of which permanent magnets are secured to hold the shims on diametrically opposite sides of the arbor while other spacers, knives and shims are freely slideable axially on the arbor and until the arbor nut is tightened to hold them all together mechanically. Our invention also provides semi-annular spacers with magnets secured on opposite axial ends whereby to adhere magnetically to magnetic spacers, shims or knives at both ends.

My invention employs quick detachable magnetic adhesion between pairs having magnetic attraction and parts made of magnetic material assembled with rotary knives on an arbor to permit radially slideable attachment and detachment when the parts are released from the firm mechanical working engagement with each other between conventional arbor nuts and shoulders.

BRIEF DESCRIPTION OF THE DRAWINGS

It is known in the art of rotary slitting and/or shearing, that knives are keyed and mounted in axially spaced pairs on pairs of arbors having parallel axes wherein diametrically proximate coacting pairs of knives are rotated to slit or shear relatively narrow strips from wide sheets of metal, papers, plastics and the like as illustrated and described briefly in our assignee's prior U.S. MacPherson Pat. No. 3,081,661. In that patent, as in FIG. 8 of the drawings of this application, conventional arbor shoulders 15 comprise axial abutments against which the knives 11 and interposed spacing means are tightly and conventionally compressed by arbor nuts 16 and held rigidly and fixedly on the arbors for efficient and effective shearing and slitting action. In the prior art MacPherson patent the spacing means 13 comprise annular thick and thin rings selected to space the juxtaposed pairs of knives 11 on the upper and lower arbors 12 in proper desired working relation to each other. For rule of thumb in this application, spacers have greater axial thickness and length than shims and provide coarser adjustment of the spacing between knives than do the thinner shims which are employed for fine adjustment, see FIG. 2 for example. In FIG. 8, conventional annular metallic spacers 14, which do not carry magnets are shown between pairs of knives 11 to suggest merely that compatibility with the present invention for providing minimum non-adjustable spacing between knives that are not expected to be more closely spaced for a given run or set-up.

Figure 1:
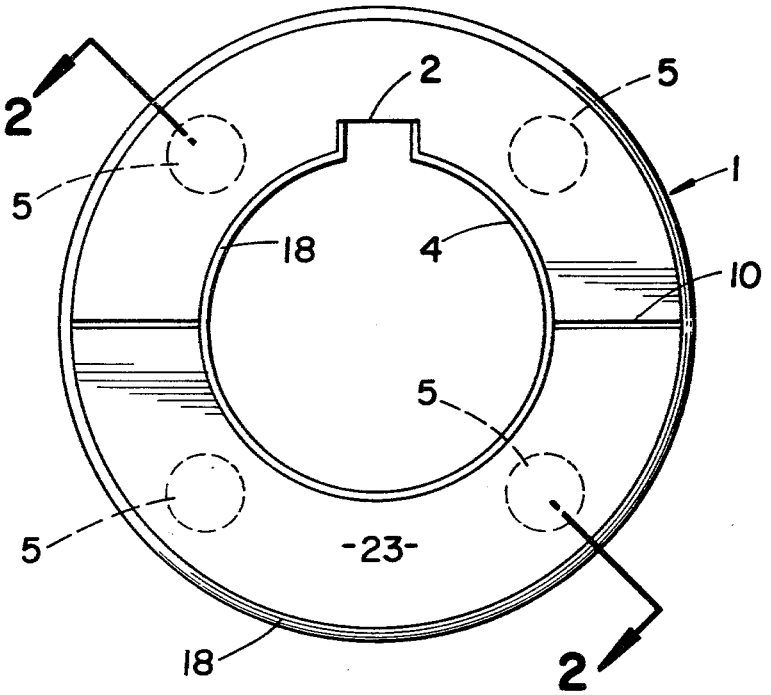
FIG. 1 is a front elevation of a spacer embodying one form of my invention and comprising four, diagrammatically suggested permanent magnets mounted in one of its axial ends slightly below the plane of said end and holding a pair of shims of magnetic material thereon.
Figure 2:
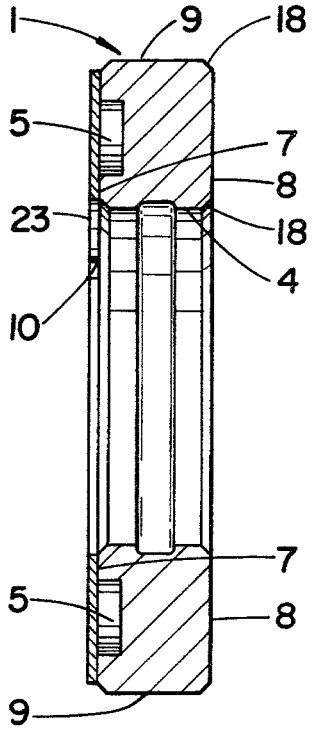
FIG. 2 is a diametrical sectional view of the spacer and shims shown in FIG. 1 taken through a diametrically aligned pair of magnets in the plane of the line 2—2 of FIG. 1.
Figure 3:
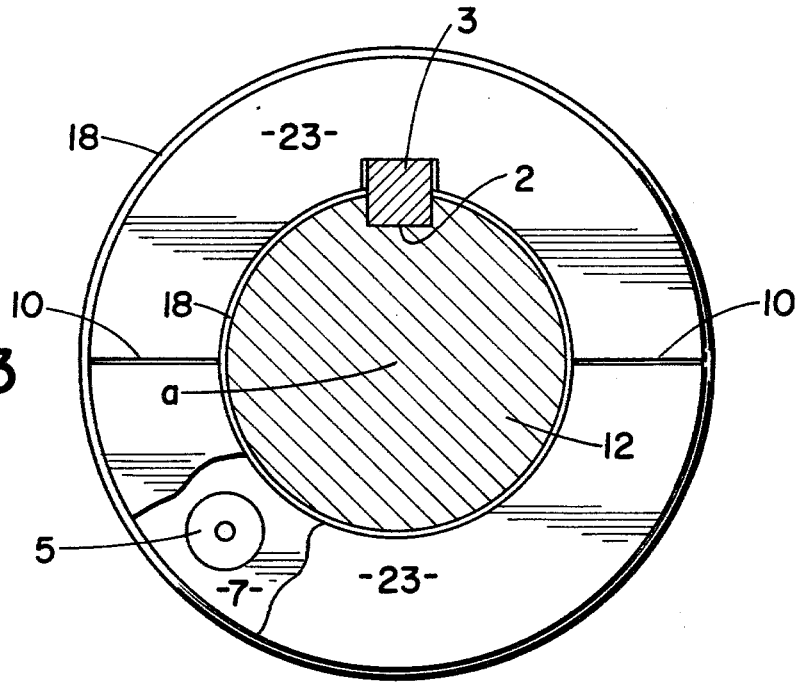
FIG. 3 is a vertical cross-sectional view through an arbor and its key upon which are mounted the pair of shims shown in FIG. 2, normal to the axis of the arbor as the shims are held magnetically from behind, as viewed, by spacing means, FIGS. 1 & 2.
Figure 4:
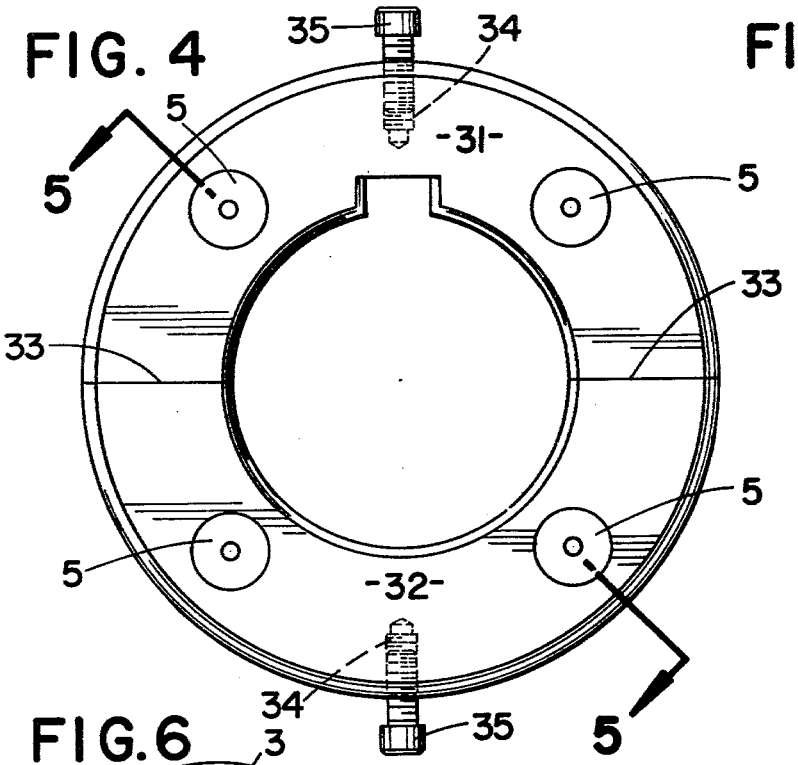
FIG. 4 is an end elevation of a pair of semi-annular spacers corresponding substantially to the single annular spacer of FIGS. 1 and 2 but is split diametrically between magnets which are disposed at both ends of the spacers.
Figure 5:
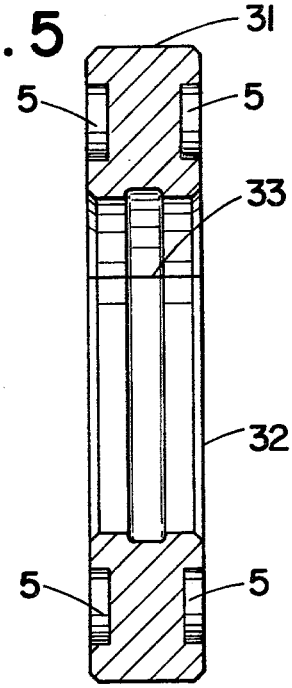
FIG. 5 is a diametrical sectional view of the split pair of semi-annular spacers shown in FIG. 4 taken in the plane of line 5—5 of FIG. 4.
Figure 6:
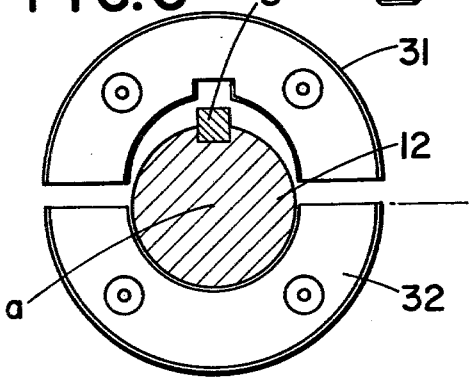
FIG. 6 is similar to FIG. 4 on a reduced scale showing the split semi-annular, half-spacers separated vertically.
Figure 8:
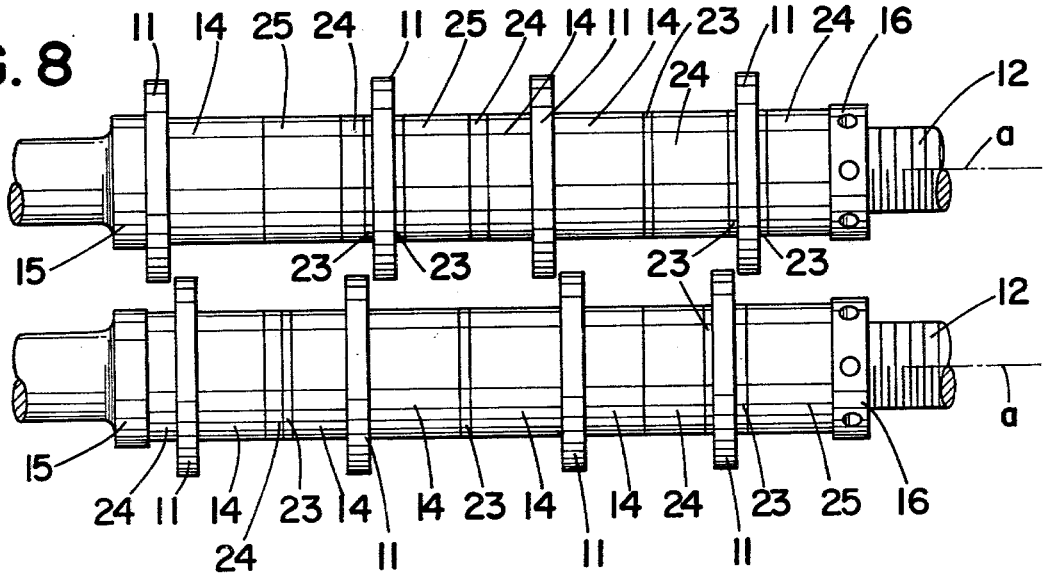
FIG. 8 is a somewhat diagrammatic illustration of the conventional disposition of a pair of arbors upon which shearing or slitting knives are fixedly mounted in spaced pairs.

As also shown or suggested in FIG. 8, my magnetically attachable and detachable spacing means comprise semi-annular pairs of magnetic shims 23, see also FIGS. 1 and 3, as well as semi-annular, magnet-carrying, ie magnetically active, spacers 31 and 32, FIGS. 4, 5 and 6, collectively marked 24 in FIG. 8, and also annular magnet carrying, magnetically active, spacers such spacers 1 in FIGS. 1 and 2 collectively marked 25 in FIG. 8. Preferably my magnetic shims 23 are suitable for use in my invention in semi-annular form and uniform thickness, FIGS. 2 and 3, and may vary in thickness axially from about 0.001" to 0.030". For practical purposes and to avoid the need for very delicate handling and care, my magnetic shims 23 may well vary by steps of 0.001" or less as from 0.0101" to 0.0102", or from 0.0120" to 0.121" and so on to about 0.0400" total uniform thickness. Coarser gross spacing is preferably cared for in the initial selection of spacers, having aggregate axial length approximately equal to the width of the strips to be slit or sheared. My magnet carrying spacers 24 and 25 of FIG. 8 may follow conventional practice of selecting gross length, having in mind my preference, however, for using magnetic shims no thinner than about 0.010". Should much thinner shims become necessary as to correct a miscalculation, the known use of very thin annular plastic shims, split on one side, may be resorted to.

Figure 7A:
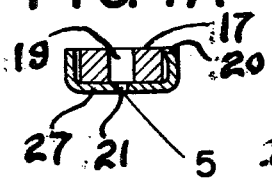
FIG. 7A is a vertical section of the magnet shown in FIG. 7 on a smaller scale than FIG. 7 and taken through one of the stakes which hold the parts together.
Figure 7:
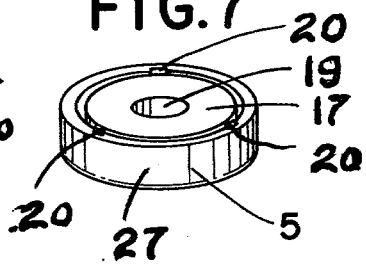
FIG. 7 is an enlarged isometric view of a right, circular cylindrical form of the magnets suggested with diagrammatic license in the spacers of FIGS. 1,2,3,4,5, and 6.

Referring to FIGS. 1 and 2 of the drawings, annular magnet-carrying spacer 1 has a notch 2 for key 3, FIG. 3, and an internal cylindrical bore 4 having a close sliding fit with arbor 12, and also carries diametrically opposite, symmetrically disposed magnets 5, FIGS. 1, 2 and 3 and see FIGS. 7 and 7A, which hold a pair of magnetic shims 23, FIGS. 2 and 3, in firm magnetic attachment with the leftward, as viewed in FIG. 2, planar face 7 of spacer 1 and in close contact with no more than 180° of arbor 12, FIG. 3. The circumferential ends of the shims 23 approach, or barely make contact in a diametric plane of the axis of arbor 12 along lines 10, FIGS. 2 and 3. Space 1 has conventionally chamfered inner and outer corner edges 18, FIGS. 2 and 3. In FIG. 3, lower shim 23 is broken away to expose face 7 and one of the magnets 5 of spacer 1 which lie behind shim 23, as viewed in FIG. 3. The rightward planar face 8 of spacer 1 is parallel with face 7, both lying normal to the axis of spacer 1 and to the coextensive longitudinal axis -a- of the arbor 12. The external cylindrical surface 9 of spacer 1, FIG. 2, is coaxial with the axis -a- of either arbor 12.

In FIGS. 4 and 5 a split pair of semi-annular or half-spacers 31 and 32, just barely touch along axial plane 33, when, like annular spacer 1, FIGS. 1 and 2, they have preferably a free sliding fit with arbor 12, and the notch 2 in half-spacer 31 engages key 3 in arbor 12, FIGS. 3 and 6. Unlike the annular spacer 1, the pair of semi-annular spacers have magnets 5 symmetrically disposed in each end of each half spacer so that one axial end of each magnet carrying half-spacer can be inserted radially alongside any magnetic part of the whole spacing means or knife, where there is proper room for it, and be magnetically secured thereto in proper contact with the arbor whilst the other axial end is thereupon available to engage magnetically and secure a shim or other intended magnetic part of the spacing means, see spacer 32 in FIG. 6.

Unlike the annular, magnet-carrying spacer 1, the semi-annular spacers 31 and 32, FIGS. 4 and 6 each have a small tapped hole 34 whose axes are normal to the axial plane 33 at the axis -a- of the arbor and into which screws 35 may be quickly hand screwed to afford a removable manual grip for sliding the half spacers radially to and from mechanical engagement with the arbor 12 and to and from magnetic engagement with a proximate intended magnetic part, not shown in FIG. 6, but necessarily lying before or behind the spacers 31 and 32 as viewed in FIG. 6 and see also FIG. 8.

Like the spacer 1, the pair of half-spacers 31-32 when assembled on and magnetically secured on, or as if on, opposite sides of an arbor as shown in FIGS. 4, 5 and 6, have, preferably the same gross geometric characteristics of right, circular, cylindrical elements and axial length, bore diameter, magnet location and mounting, but different strength of attraction because the half-spacers by definition are bigger, ergo heavier, and need stouter magnetic attraction to hold them magnetically as on the bottom side of the arbor, FIG. 6, while the axial displacement of the whole spacing means between a pair of knives is being changed.

The magnets 5 which appear diagrammatically in FIGS. 1-7 inclusive, are shown in better detail in a desirable, available commercial form in FIGS. 7 and 7A. These are permanent magnets and are sold under the trade name, Eclipse, by, among others, Permag Magnetics Corp., 2960 South Avenue, Toledo, Ohio, where applicant acquired them and used them in his experimental work. This particular and presently preferred form of magnet is called Eclipse Shallow Pot Magnet. Eclipse literature recites "They are, in effect, flat Alcomax Magnets" (marked 17 in FIGS. 7 and 7A) "assembled in mild steel shells" (or cups marked) "the magnets being cored with a countersunk hole" for countersunk screws or bolts not shown herein. Alcomax appears to be the trade mark or name of the central highly magnetized part used, and/or acquired for use, by Eclipse in its shallow pot magnets.

As shown in FIGS. 7 and 7A, the flat, Alcomax magnetic ring 17 is bonded magnetically and coaxially to and with the bottom of cup and the parts are staked together as at 20. As so assembled, a significant, radially-uniform, annular air gap, interrupted only by the small stakes 20, spaces the cylindrical exterior surface of the magnetic ring 17 from the interior cylindrical surface of the cup or shell 27.

A central hole 21 in the bottom of cup 18 has a smaller diameter than the hole 19 to permit a screw with a head as large as hole 19 to pass through hole 21 and gain screwed attachment between the magnet 5 and any tapped or tappable body such as spacers 1, 31 and 32 herein.

The exterior cylindrical and flat bottom surfaces of the cups 27, as purchased by applicant, are provided with a hard exterior resin coating which facilitates their permanent attachment to their corresponding shallow holes in spacers 1, 31 and 32 wherein, FIGS. 2 and 5, by first putting a bit of epoxy resin glue in the bottoms of such holes and pressing down magnets 5 thereinto, whereby to seal the exteriors of the cups to the holes in the spacers permanently and firmly.

These Eclipse magnets are provided with keepers or armatures of magnetic material to cover the upper face of the ring 17 and the brim of the cup 27 to preserve the magnetic field when the magnets are not in use. These Eclipse shallow pot magnets are presently available and have utility for my purposes in a range of sizes in which the smallest is 5/16" high, ¾" in diameter, weighs ½ oz. and has a maximum hold or pull of 7 lbs. for axial detachment with, however, very much less effort for making a sliding detachment across the face of the magnet. The larger size magnet of 7/16" high 1½" diameter, weighing 3½ oz. has a 30 lb. hold against axial detachment from first class magnetic material.

Referring to FIG. 8, it will be appreciated by those skilled in the art that my half-spacers 31 and 32 in FIGS. 4, 5 and 6, and marked 24 in FIG. 8 may, under various circumstances, have utility without necessarily having magnets on both ends, and may, if employed beside a magnet-carrying spacer, be useful as a magnetic spacer, magnetically attracted to a magnet-carrying one.

In the foregoing description, the phrase magnetic material, magnetic shim or magnetic spacer has been used herein to designate the metallic things such as iron which do not comprise a magnet as such, but whose magnetic role in my invention is passive, or relatively passive even when and if they retain some normal residual magnetism. On the other hand, the phrase magnet-carrying spacer or spacers has been used herein to designate, without limitation, the magnetic things whole role is active in providing the magnetic fields capable of attracting and holding magnetic materials according to the foregoing teaching about the practice and principles of my invention.

While I have described and exemplified preferred and specific forms of my invention, alterations thereof and improvements thereupon will occur to those skilled in the art without departing from the essential teachings and principles of my invention. Therefore I do not want to be limited in the scope and effect of my patent to the particular forms and examples herein shown, nor in any way inconsistent with the progress by which my invention has promoted the art.

I claim:

1. Means for changing the axial distance between rotary knives mounted operatively on a driving arbor which has a central axis and are compressed between an arbor shoulder and an arbor nut, comprising the improvement that parts of said means are magnetically attached to and quickly detachable from other parts when said parts and said knives are not compressed between said nut and shoulder and have freedom for relative axial movement without removal from said arbor.

2. In an assembly of rotary knives keyed to an arbor which has a central axis with spacing means for spacing the knives from each other axially on the arbor when the assembly is forcibly compressed axially and wherein said spacing means may comprise annular, right, circular, cylindrical parts which are movable onto and removable from said arbor only axially, the improvement that said means also comprises pairs of semi-annular parts which may be removed from and placed upon said arbor radially when the assembly is free of axial compression and that said radially removable parts are magnetically attached in said assembly when said assembly is free of axial compression.

3. The improvement according to claims 1 or 2, wherein certain of said parts carry magnets in an axial end which has a surface normal to the axis of the arbor and others of said parts are made of magnetic material and disposed proximate said magnets.

4. The improvements of claim 3 wherein said magnets lie axially below said surface and are permanently secured in said certain of said parts.

5. The improvement of claims 1 or 2 wherein said magnetic attachment between said parts persists and is not modified adversely when said parts are mechanically compressed axially on said arbor.

6. The improvement according to claims 1 or 2 wherein certain of said parts have relatively great axial thickness and others of said parts are relatively thin axially and wherein the thicker parts carry magnets and the thinner parts are made of magnetic material.

7. The improvement of claim 1 wherein said means comprise spacers that extend axially less than the whole axial distance between adjacent knives on the same arbor and comprise shims having axial thickness equal to the difference between the axial extent of said spacers and the desired axial spacing between said knives, one of said spacers having magnets in one axial end, and said shims being made of magnetic material and radially attachable to and removable from said end of said spacer when said means and knives are loosely assembled on said arbor.

8. The improvement of claim 7 wherein one of said spacers has planar faces at both axial ends thereof with magnets embedded in both said faces.

9. The improvement of claim 8, wherein one said magnet carrying spacers comprises a semi-annular pair each of less than a diametric half of the circumferential length around said arbor.

* * * * *